US006349551B1

(12) United States Patent
Jirnov et al.

(10) Patent No.: US 6,349,551 B1
(45) Date of Patent: Feb. 26, 2002

(54) THERMODYNAMIC POWER AND CRYOGENIC REFRIGERATION SYSTEM USING LOW TEMPERATURE HEAT SOURCE

(76) Inventors: Alexei Jirnov; Olga Jirnov; Mikhail A. Jirnov, all of 9105 Braeburn Valley Dr., Unit 14, Houston, TX (US) 77074

( * ) Notice: Subject to any disclaimer, the term of this patent is extended or adjusted under 35 U.S.C. 154(b) by 0 days.

(21) Appl. No.: 09/448,557

(22) Filed: Nov. 23, 1999

(51) Int. Cl.[7] ..... F25D 9/00
(52) U.S. Cl. ..... 62/87; 62/467
(58) Field of Search ..... 62/87, 467, 402

(56) References Cited

U.S. PATENT DOCUMENTS 3,154,928 A * 11/1964 Harmens ..... 62/53
3,992,891 A * 11/1976 Pocrjna ..... 62/53

* cited by examiner

*Primary Examiner*—Ronald Capossela
(74) *Attorney, Agent, or Firm*—Kenneth A. Roddy

(57) ABSTRACT

A thermodynamic power and cryogenic refrigeration system using a first and second (binary) working fluid has a low-temperature closed bottoming cycle and an open or closed topping cycle. In the bottoming cycle a mixture of a first gas such as helium or hydrogen and a low temperature liquid such as liquefied nitrogen is compressed in a polytropic process and then the liquid content is separated. The separated first gas is heated using rejected heat from a second gas expanded in the topping cycle or ambient air and then the heated first gas is adiabatically expanded and supercooled while performing useful work and thereafter is fed to the compressor and mixed with the separated liquid to serve as a coolant and facilitate rejection of polytropic heat and to supplement the cool gas/liquid mixture providing polytropic compression of the first gas and thus completes the bottoming cycle. The bottoming cycle functions to cool the second gas and liquefy it in the topping cycle. The topping cycle is an open or closed modified Rankine cycle. The topping cycle uses heat of seawater and/or ambient air or other low-temperature heat source to simultaneously produce a refrigerant and power. The apparatus of the closed bottoming cycle may also function without the apparatus of the topping cycle using a low temperature heat source to produce a refrigerant and power.

12 Claims, 8 Drawing Sheets

THERMODYNAMIC POWER AND CRYOGENIC REFRIGERATION SYSTEM USING LOW TEMPERATURE HEAT SOURCE

CROSS REFERENCE TO RELATED APPLICATION

This application is a continuation-in-part of U.S. patent application Ser. No. 08/929,294, pending.

BACKGROUND OF THE INVENTION

1. Field of the Invention

This invention relates generally to heat engines and refrigeration apparatus that utilize bottoming and topping cycles and binary working fluid, and more particularly to a combined thermodynamic power and cryogenic refrigeration system utilizing a binary working fluid and having a low-temperature bottoming cycle and an open or closed modified Rankine topping cycle.

2. Brief Description of the Prior Art

It is known that any thermodynamic system operating on a cycle and receiving heat while doing work must also have a heat-rejection process as part of the cycle. Most prior art systems having thermodynamic cycles require two external heat reservoirs. However, a heat-rejection process may be made up in closed cycles with only a single external heat reservoir, provided that the work medium is a combined mixture of a non-condensable first gas such as helium or hydrogen and a low-temperature liquid such as liquefied nitrogen, methane, water with antifreeze, etc., wherein the low-temperature liquid is used as an internal cold reservoir to carry out the heat-rejection process and the non-condensable first gas is supercooled during adiabatic expansion producing useful work and serves as a coolant to heated liquid recovering from an initial condition of the gas/liquid mixture. Therefore, it is possible to construct a heat engine which will do work and exchange heat using a single external heat reservoir with heat of seawater and/or ambient air as a heat source in an open or closed low-temperature cycle. The conversion of the heat energy into another form is appreciably enhanced by employing a binary working fluid in a low-temperature closed bottoming cycle for cooling and to liquefy the working fluid of a closed modified Rankine topping cycle or for cooling ambient air before compressing it in an open topping cycle.

SUMMARY OF THE INVENTION

It is therefore an object of the present invention to provide a combined thermodynamic power and cryogenic refrigeration system using a low-temperature heat source such as ambient air and seawater which can generate a large amount of refrigeration and power simultaneously.

It is another object of this invention to provide a thermodynamic power and cryogenic refrigeration system which can utilize a variety of low-temperature heat sources, including solar, ambient air, seawater, geothermal heat, etc.

Another object of this invention is to provide a combined thermodynamic power and cryogenic refrigeration system using a low-temperature heat source which may be effectively used for liquefaction of several gases.

Another object of this invention is to provide a combined thermodynamic power and cryogenic refrigeration system using a low-temperature heat source that can be used as a heat pump wherein a portion of cool ambient air is used to cool or to heat another portion of air simultaneously.

A further object of this invention is to provide a combined thermodynamic power and cryogenic refrigeration system using a low-temperature heat source which may be effectively used in superconductivity technology.

A still further object of this invention is to provide a combined thermodynamic power and cryogenic refrigeration system using a low-temperature heat source which does not produce environmentally damaging emissions.

Other objects of the invention will become apparent from to time throughout the specification and claims as hereinafter related.

The above noted objects of the invention are accomplished by a combined thermodynamic power and cryogenic refrigeration system that utilizes a cryogenic refrigeration bottoming cycle operating on a binary working fluid in combination with an open or closed modified Rankine topping cycle wherein the low-temperature bottoming cycle functions to cool and liquefy the working fluid of the modified Rankine topping cycle.

The apparatus of the bottoming cycle includes a sliding-blade gas/liquid compressor, a sliding-blade expander, a vortex separator, a heat exchanger, a plurality of liquid atomizers, a pump, gas and liquid storage tanks, temperature and pressure sensors, and control means for adjustable controlling the volume of fluids in the system contained within a thermally insulated housing.

In operation, rotation of the gas/liquid compressor rotor, draws a first gas (such as helium or hydrogen) into the gas expander where it is adiabatic expanded producing useful work and supercooled. Simultaneously, a fine dispersed low-temperature liquid (such as liquefied nitrogen, methane, water with antifreeze, etc.) is injected into the operating chamber of the gas/liquid compressor through the plurality of liquid atomizers to produce a cool gas/liquid mixture at a quantity sufficient for polytropic heat adsorption and polytropic compression of the first gas.

The compressed cool gas/liquid mixture is discharged into the vortex separator where the cool first gas that rejected polytropic heat is separated from the low-temperature liquid and supplied to the heat exchanger where it is isobarically heated using rejected heat of the working fluid of the modified Rankine topping cycle (latent heat of vaporization) and then enters the expander operating chamber where it is adiabatic expanded and supercooled doing useful work by simultaneously rotating the expander and gas/liquid compressor rotors. The adiabatically expanded and supercooled first gas with a cryogenic temperature is discharged from the expander and enters the gas/liquid compressor and is mixed with the fine dispersed low-temperature liquid to serve as a coolant and facilitate rejection of polytropic heat and supplement the cool gas/liquid mixture which is polytropically compressed to complete the bottoming cycle.

The apparatus of the closed topping cycle includes a pump, a gas (ambient air) heat exchanger, a liquid (seawater) heat exchanger, a gas expander, a gas storage tank, temperature and pressure sensors, and control means for adjustably controlling the volume of fluids in the system.

In operation of the closed topping cycle, rotation of the pump rotor draws a second gas from the heat exchanger of the bottoming cycle where it is cooled and liquefied rejecting mainly latent heat of vaporization. The liquefied second gas enters the pump where it is compressed and discharged into the topping cycle heat exchanger where it is isobarically heated and evaporated using a low-temperature heat source such as ambient air and seawater and then enters the operating chamber of the gas expander where it is adiabatic expanded doing useful work by simultaneously rotating the gas expander and the pump rotors. The expanded second gas is discharged from the gas expander into the heat exchanger of the bottoming cycle and is cooled and liquefied transferring its rejected heat to the working fluid of the bottoming cycle. The expanded, cooled and liquefied second gas with a cryogenic temperature is discharged from the heat exchanger of the bottoming cycle and is fed to the pump and compressed to complete the topping cycle.

The apparatus of the closed bottoming cycle may also function without the apparatus of the topping cycle using a low-temperature heat source to produce power and liquefy different gases. The closed bottoming cycle may function with an open topping cycle as a heat pump for warming cool ambient air by the addition of an air compressor and expansion valve connected with the gas compressor. In this modification, cool ambient air is drawn into the operating chamber of the air compressor upon rotation and it is adiabatically compressed and discharged into the expansion valve, which throttles the compressed air, and supplies heated air to the user. It may also be used without a topping cycle as a cooling system in the summer.

DESCRIPTION OF THE PREFERRED EMBODIMENTS

Figure 1:
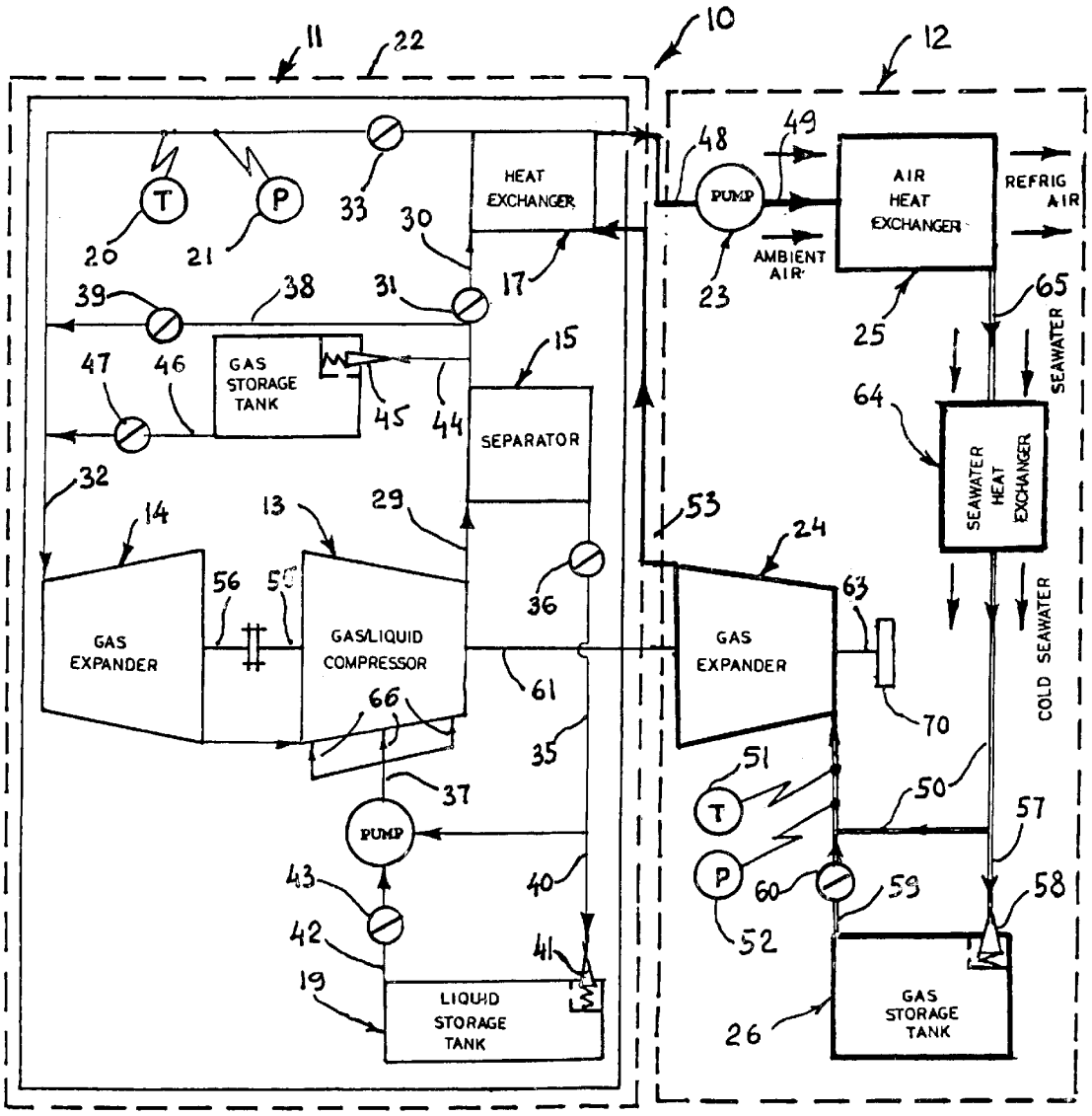
FIG. 1 is a schematic block diagram of the thermodynamic power and cryogenic refrigeration system using a low-temperature heat source and a having a closed binary fluid bottoming cycle and modified Rankine topping cycle in accordance with the present invention.

FIG. 1 is a schematic diagram of a preferred embodiment 10 of the combination power and cryogenic refrigeration system using a binary working fluid in accordance with the present invention.

The embodiment of FIG. 1 has a closed bottoming cycle 11 and an open or closed modified Rankine topping cycle 12. The apparatus 11 of the bottoming cycle includes a sliding-blade gas/liquid compressor 13, a gas expander 14, a vortex separator 15, a pump 16, a heat exchanger 17, a gas storage tank 18, a liquid storage tank 19, and temperature and pressure sensors 20 and 21, which are contained within a thermally insulated housing 22. A non-condensable first gas such as helium or hydrogen far from its saturation point is stored in the gas storage tank 18, and a low-temperature liquid such as liquefied nitrogen, methane, water with antifreeze, etc., is stored in the liquid storage tank 19 under high pressure.

The flow paths of the working fluids are shown by arrows in FIG. 1 during the operation of the bottoming 11 and topping 12 cycles. As the rotor of the gas-liquid compressor 13 rotates, the supercooled first gas is drawn into the gas/liquid compressor 13 from gas expander 14. Simultaneously, a fine dispersed low-temperature liquid from the storage tank 19 is injected into the operating chamber of the gas/liquid compressor 13 through the plurality a liquid atomizers 66 by means of the pump 16 and the mixture is compressed in a polytropic process in the gas-liquid compressor. The compressed cool gas/liquid mixture is discharged into the vortex separator 15 through a conduit 29 where the cool first gas is separated from the low-temperature liquid and supplied to the heat exchanger 17 through a conduit 30 and a throttle 31.

The separated first gas is isobarically heated in the heat exchanger 17 using rejected heat of the modified Rankine topping cycle working fluid and then enters the gas expander 14 through a conduit 32 containing a throttle 33 and temperature sensor 20 and pressure sensor 21 which are disposed below the throttle 33.

During adiabatic expansion and supercooling, the first gas performs useful work by causing simultaneously rotation of the gas expander 14 and gas/liquid compressor 13 rotors. The adiabatically expanded and supercooled first gas with a cryogenic temperature is discharged from the gas expander 14 and enters the gas/liquid compressor 13 through a conduit 34. The separated liquid from the separator 15 is supplied to the pump 16 through a conduit 35 and throttle 36 and pumped through the conduit 37 and liquid atomizers 66 into the operating chamber of the gas/liquid compressor 13 to produce a cool gas/liquid mixture. The adiabatically expanded and supercooled first gas serves as a coolant and is used to facilitate rejection of polytropic heat and supplement the cool gas/liquid mixture which is compressed in a polytropic process to complete the bottoming cycle.

The conduit 32 between the gas expander 14 and the heat exchanger 17 and the conduit 30 between the vortex separator 15 and the heat exchanger 17 are joined together by a bypass conduit 38 containing a throttle 39. The bypass conduit 38 is disposed below the throttles 31 and 33 to conduct flow through the bypass when the throttle 39 is open and the throttles 31 and 33 are closed.

The liquid storage tank 19 has an inlet connected to the conduit 35 between the throttle 36 and the pump 16 through a conduit 40 and a one-way spring valve 41 and has an outlet connected to the pump 16 through a conduit 42 containing a throttle 43.

The gas storage tank 18 has an inlet connected to the conduit 30 through conduit 38 between the vortex separator 15 and the throttle 31 through a conduit 44 and one-way spring valve 45 and has an outlet connected to the conduit 32 below a throttle 33 through a conduit 46 containing a throttle 47.

Temperature and pressure sensors 20 and 21 are disposed in conduit 32 adjacent to its juncture with the bypass conduit 38. The temperature and pressure sensors 20 and 21 are connected with the throttles 33, 39, 47, and 31 to control their operation in response to the temperature and pressure in the conduit 32, and thereby regulate the power conditions.

The throttles 33, 39, and 31 control the mode of operation of the heat exchanger 17. Throttle 47 meters out the first gas into the system from the gas storage tank 18. Throttle 43 meters out the liquid into the system from the liquid storage tank 19. Throttle 36 located in the conduit 35 allows additional control of the first gas and liquid distributed from the vortex separator 15 through the conduits 35 and 30.

The spring valves 45 and 41 maintain a predetermined pressure in the gas storage tank 18 and the liquid storage tank 19, respectively.

The shafts 55 and 56 of the rotors of the gas expander 14 and gas/liquid compressor 13 are joined together by splines or other suitable means such that the rotors rotate together.

The apparatus of the closed modified Rankine topping cycle 12 of the system 10 includes a rotary pump 23, a rotary gas expander 24, a gas (air) heat exchanger 25, a liquid (seawater) heat exchanger 64, and a gas storage tank 26.

In operation of the closed topping cycle portion 12, as the rotors of the pump 23 and gas expander 24 rotate, a second gas is drawn through the heat exchanger 17 of the bottoming cycle portion 11 whereupon it is cooled, liquefied and enters the pump 23 of the topping cycle portion 12 through a conduit 48 and is compressed. The compressed liquefied second gas is discharged into the gas (air) heat exchanger 25 through a conduit 49 and the liquid (seawater) heat exchanger 64 through a conduit 65 where it is isobarically heated and evaporated using the heat of the ambient air and seawater or other heat source to produce refrigerated air and then it enters the gas expander 24 through a conduit 50 containing temperature sensor 51 and pressure sensor 52.

The gas storage tank 26 is connected to the outlet of the liquid (seawater) heat exchanger 64 through a conduit 57 and one-way spring valve 58 and has an outlet connected to the conduit 50 through a conduit 59 containing a throttle 60. The temperature and pressure sensors 51 and 52 are connected with the throttle 60 to control its operation in response to the temperature and pressure in the topping cycle portion 12 of the system and thereby regulate the power condition. The adiabatically expanded second gas does useful work by simultaneously rotating the rotors of the gas expander 24 and pump 23 and is discharged from the gas expander 24 into the heat exchanger 17 of the bottoming cycle portion 11 of the system through a conduit 53. The second gas is cooled and liquefied in the heat exchanger 17 by transferring its rejected heat to the first gas (working fluid of the bottoming cycle) and is fed into the pump 23 of the topping cycle portion 12 through the conduit 48 and is compressed to complete the open or closed topping cycle.

The shafts 55, 56, and 61 of the rotors of the gas/liquid compressor 13 and gas expander 14 of the bottoming cycle 11 and the shaft 62 of the rotor of the gas expander 24 of the topping cycle 12 are joined together by splines or other suitable means such that the rotors rotate together. A pulley 70 may be mounted on the outer end of the shaft 63 of the rotor of the gas expander 24 for power take off.

Figure 2:
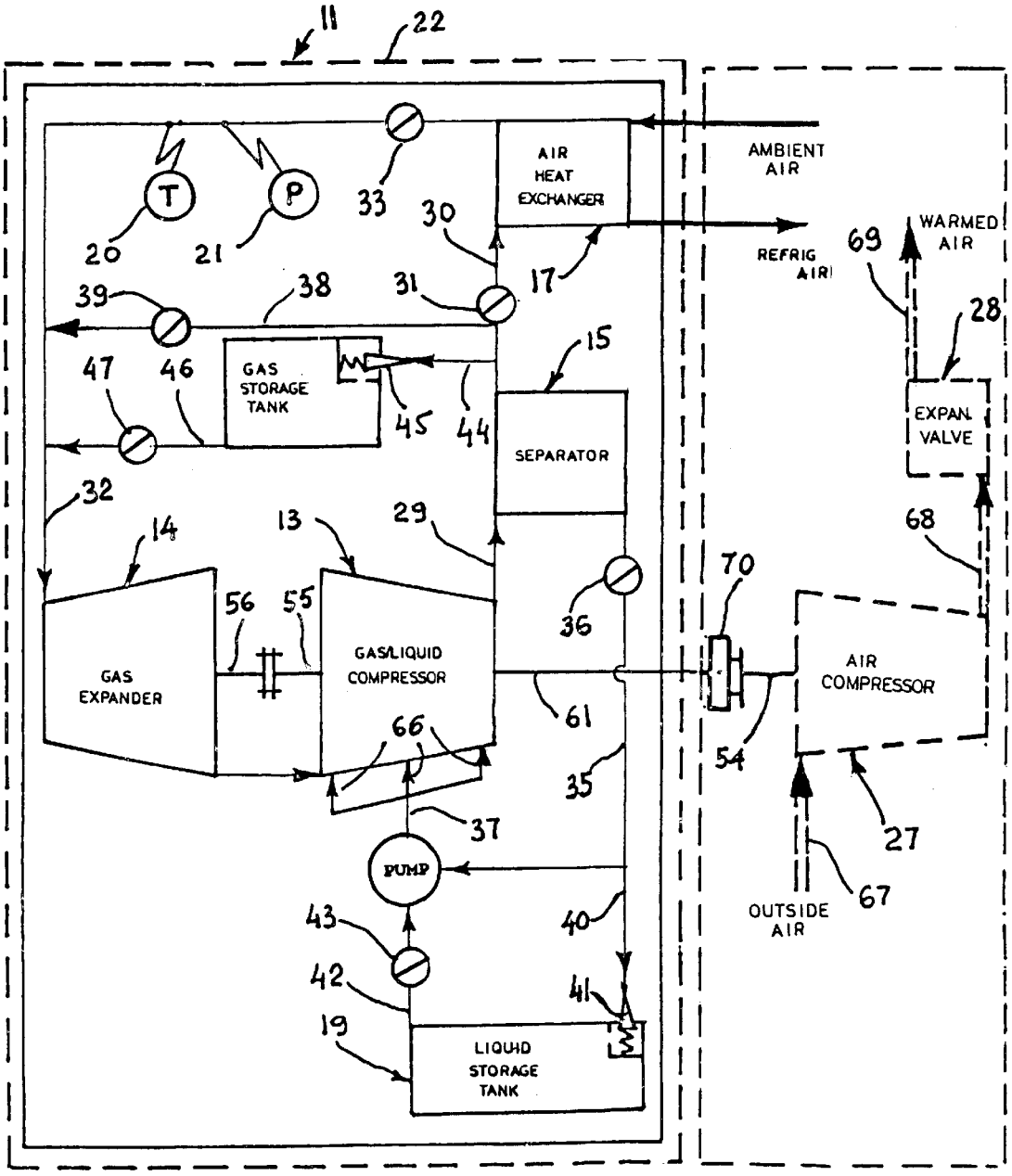
FIG. 2 is a schematic block diagram of the bottoming cycle apparatus of the power and cryogenic refrigeration system functioning as a heat pump.

As shown schematically in FIG. 2, the apparatus of the bottoming cycle 11 may also be used with an open topping cycle to serve as a heat pump in the winter and without a topping cycle as a cooling system in the summer and may employ various other low-temperature heat sources. The apparatus of the bottoming cycle 11 is the same as described above. In functioning as a heat pump, the apparatus 11 is connected with an air compressor 27 and expansion valve 28 (represented in dashed line). To accomplish this, the shaft 61 of the rotor of the bottoming cycle gas expander 14 is joined to the shaft 54 of the rotor of the topping cycle air compressor 27 or to the pulley 70 or by other means such that the gas expander shaft 61 and air compressor shaft 54 rotate together.

When functioning as a heat pump, cool ambient air is drawn into the air compressor 27 through a conduit 67. The cool ambient air is adiabatically compressed in the air compressor 27 and discharged into the expansion valve 28 through a conduit 68 where the compressed air is throttled and the heated air is supplied to the user through a conduit 69.

For use as a cooling system in the summer, the heat exchanger 17 of the bottoming cycle apparatus 11 is connected with an air inlet conduit 71 and an air outlet conduit 72. The apparatus of the bottoming cycle 11 is the same as described above but without a topping cycle and utilizing ambient air which enters the heat exchanger 17 through the conduit 71 and is discharged through the conduit 72 as cool refrigerated air. A pulley 70 may be mounted on the outlet end of the shaft 61 of the rotor of the gas expander 14 for power take off while producing refrigerated air.

Figure 3:
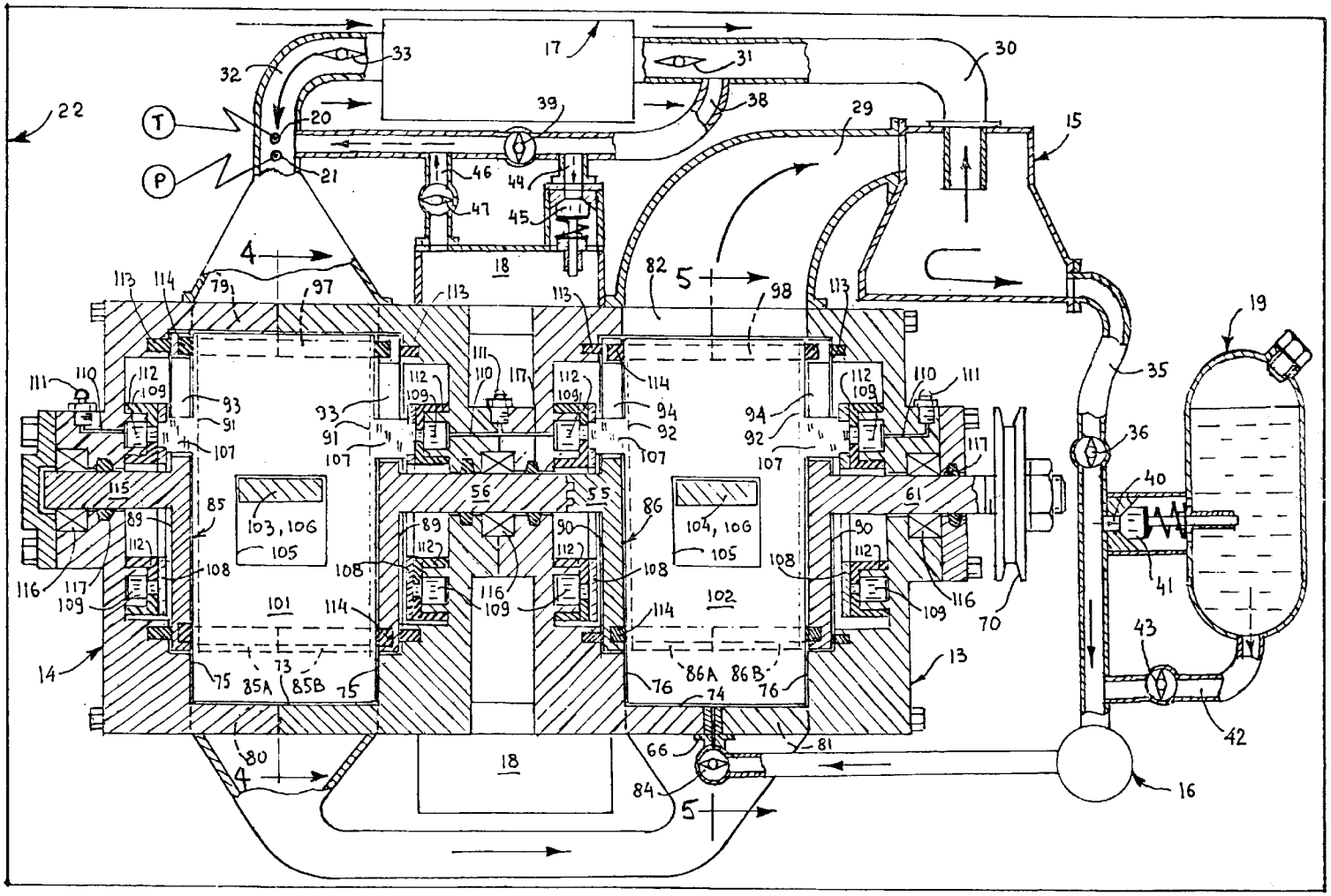
FIG. 3 is a detailed longitudinal cross section through the bottoming cycle apparatus of the power and cryogenic refrigeration system.

Referring now to FIGS. 3–6, the apparatus 11 of the bottoming cycle will be described in greater detail. In FIG. 3, the apparatus 11 is shown in longitudinal cross section. The gas expander operating chamber 14 of the apparatus 11 is shown in transverse cross section in FIG. 4 and the gas/liquid compressor operating chamber 13 is shown in transverse cross section in FIG. 5. The gas expander operating chamber 14 and the gas/liquid compressor operating chamber 13 are each defined by oval-shaped cavities having contoured oval-shaped side walls 73 and 74 and opposed facing flat end walls 75 and 76, respectively.

Continuous cylindrical-shaped guide grooves 77 and 78 are formed in the opposed interior surfaces of the flat end walls 15 and 16 of the gas expander operating chamber 14 and gas/liquid compressor operating chamber 13, respectively. The interior and exterior peripheral surfaces of the guide grooves 77 and 78 are raised above the flat surface of the end walls. The center "A" of the cylindrical-shaped guide grooves is concentric with the center of the oval-shaped gas expander chamber 14 and gas/liquid compressor operating chamber 13.

Figure 4:
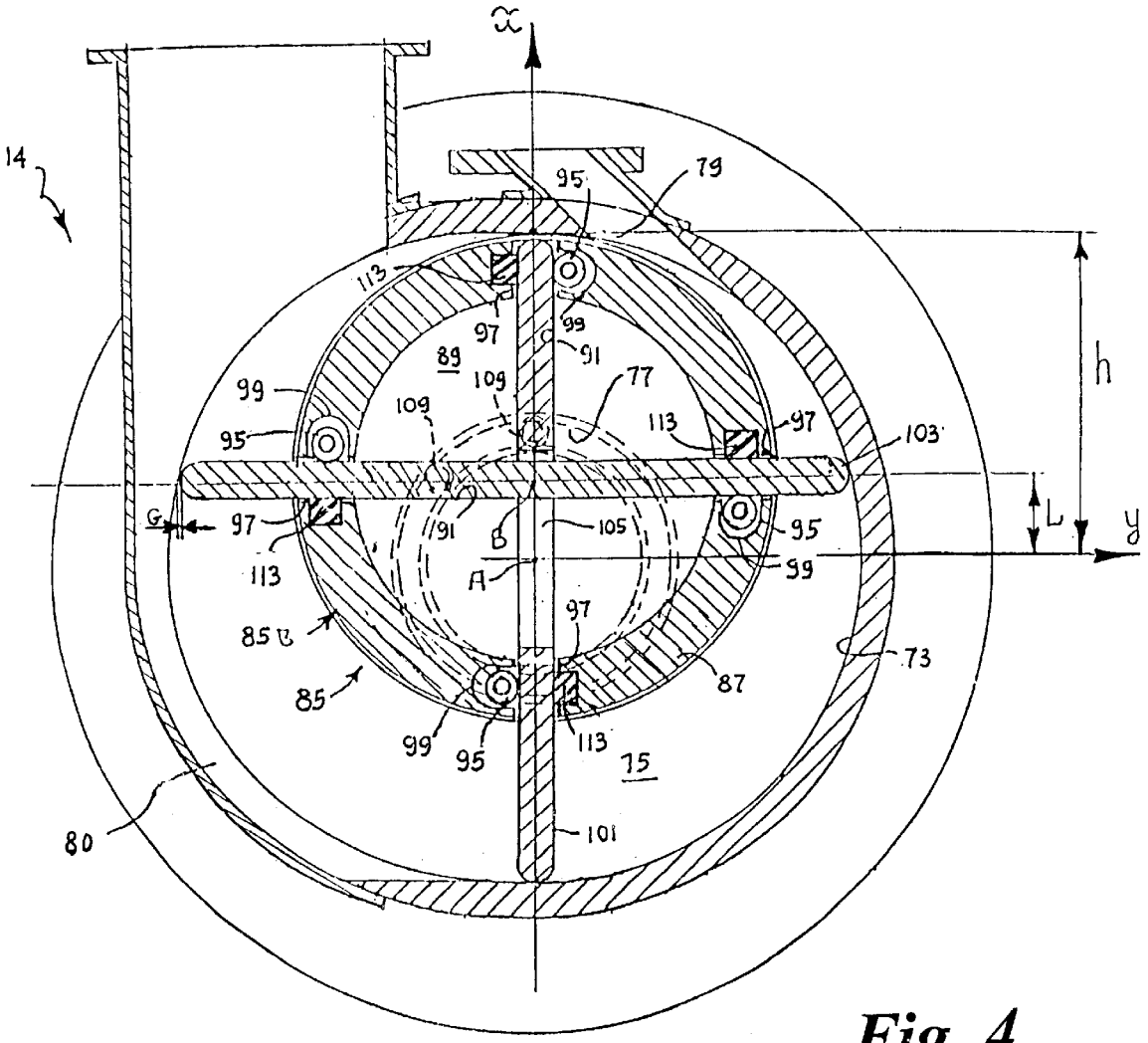
FIG. 4 is a transverse cross section through the expander chambers of the power and cryogenic refrigeration system along line 4—4 of FIG. 3.

As best seen in FIG. 4, the gas expander chamber 14 has an inlet port 79 through its side wall 73 positioned at an angle to allow entry of the working medium into the chamber tangential to the plane of rotation and a relatively large outlet port 80 which extends circumferentially along approximately one-half of its side wall and allows the working medium to exit tangential to the plane of rotation. The width of the inlet port 79 and outlet port 80 are approximately the same width as the expander chamber 14 to provide maximum filling of the volume of the chamber and minimize hydrodynamic loss.

Figure 5:
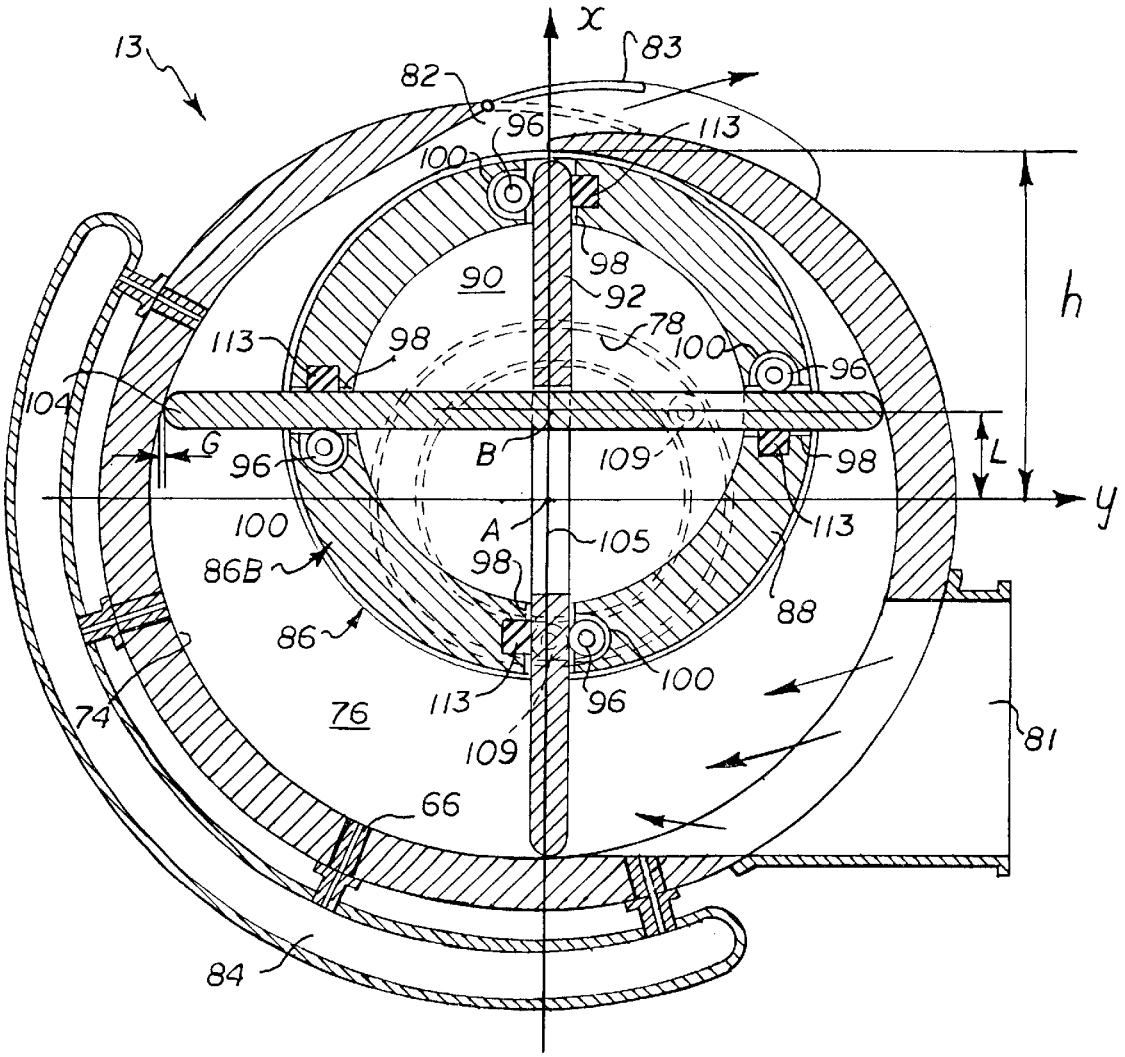
FIG. 5 is a transverse cross section through the gas/liquid compressor chamber of the power and cryogenic refrigeration system along line 5—5 of FIG. 3.

As best seen in FIG. 5, the gas/liquid compressor chamber 13 has an intake port 81 through its side wall 74 positioned to allow entry of a gas/liquid mixture into the chamber tangential to the plane of rotation and an angular exhaust port 82 through its side wall which allows the gas/liquid mixture to exit tangential to the plane of rotation. The width of the intake port 81 and exhaust port 82 are approximately the same width as the compressor chamber 13 to provide maximum filling of the volume of the chamber and minimize hydrodynamic loss. The exhaust port 82 is provided with a one-way valve 83 which allows the gas/liquid mixture to flow only out of the compressor operating chamber.

An arcuate hollow liquid channel 84 is spaced a distance from the outside of the side wall 74 of the gas/liquid compressor chamber 13. A series of circumferentially spaced liquid atomizers 66 extend radially between the liquid channel and the side wall 74 and join the interior of the liquid channel 84 and the interior cavity of the gas/liquid compressor operating chamber 13 in fluid communication.

A sliding-blade expander rotor 85 and a sliding-blade compressor rotor 86 are rotatably disposed in the respective expander operating chamber 14 and compressor operating 13.

Figure 6:
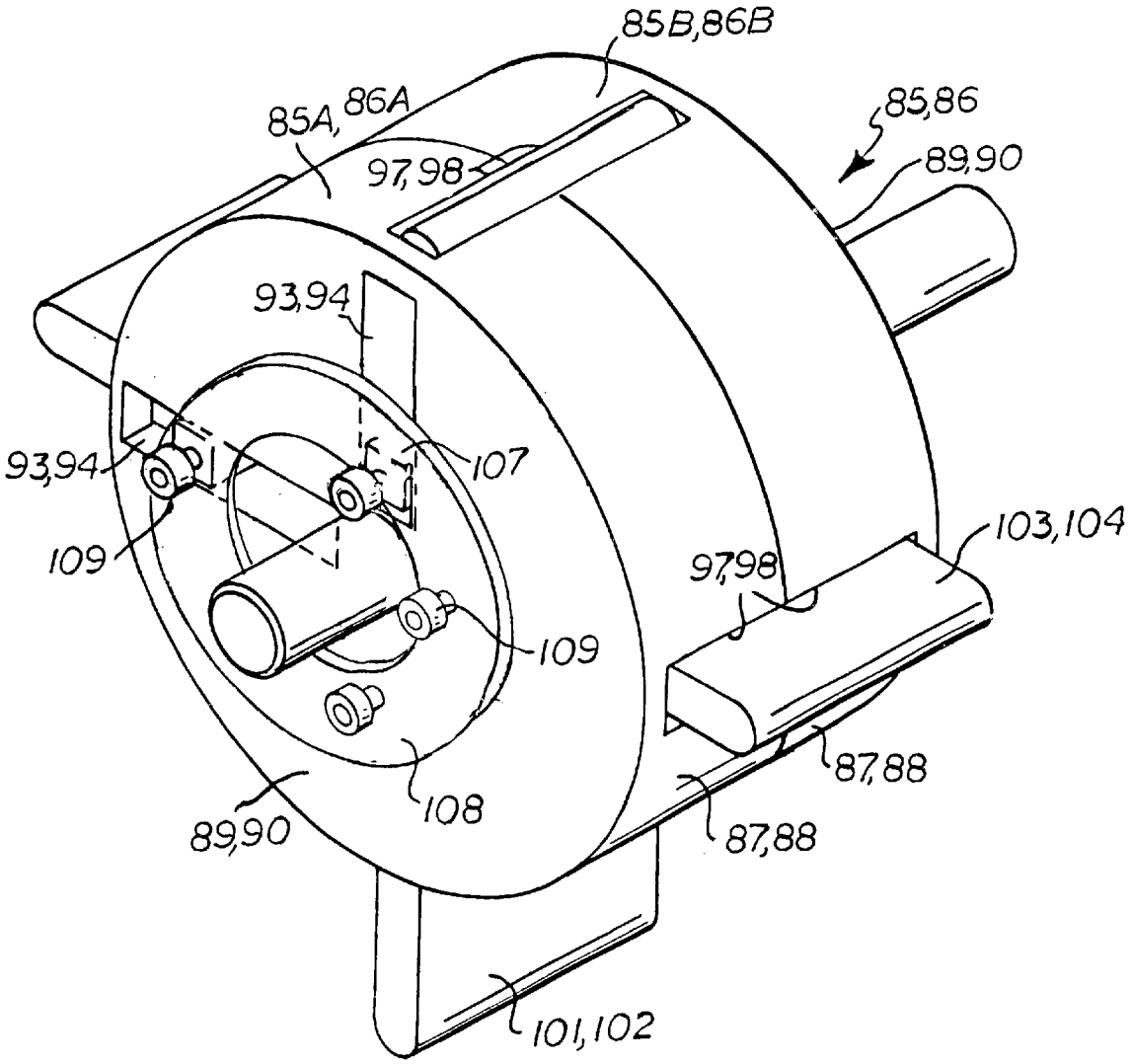
FIG. 6 is an isometric view of the expanders and gas/liquid compressor rotor of the power and cryogenic refrigeration system shown in an assembled condition.

As best seen in FIG. 6, the expander rotor 85 and compressor rotor 86 are each formed by a pair of opposed hollow cylindrical members 85, 85B, and 86, 86B, respectively, each having a circular side wall 87 and 88 and an end wall 89 and 90. A pair of perpendicular elongate rectangular slots 91 and 92 are formed in the interior of the end walls 89 and 90 of the cylindrical member 85, 85B and 86, 86B and extend through the center of rotation of the cylindrical members. A portion of the slots 91 and 92 on one side of the center of rotation extend all the way through the flat end walls 89 and 90 of the cylindrical members 85A, 85B and 86A, 86B to form a pair of rectangular perpendicular slots 93 and 94 through the outer surface of the flat end walls 89 and 90, as best seen in FIGS. 3, 4, 5 and 6.

A series of circumferentially spaced rectangular slots 97 and 98 extend through the circular side walls 89 and 90 of the circular members 85A, 85B and 86A, 86B from their open end and terminate at the flat end walls 89 and 90 in axial alignment with the slots 91 and 92 in the flat end walls.

As shown in FIGS. 4 and 5 rollers 95 and 96 are mounted in recesses 99 and 100 in the side walls 87 and 88 of the cylindrical member 85A, 85B and 86A, 86B closely adjacent each slots 97 and 98 with their curved exterior surface protruding a short distance into the slot opening.

A pair of perpendicular elongate rectangular rigid blades 101, 102, and 103, 104 are slidably received in the elongate slots 91 and 92, respectively. One blade 101, 103 of each pair is provided with a central rectangular opening 105 and the other blade 102, 104 of each pair is provided with a central narrow rectangular portion 106 which is received through the opening 105 such that the perpendicular blades 101, 102, and 103, 104 can slide independently relative to one another. A foot lug 107 extends outwardly a short distance from the opposed side edges of each blade 101, 102, and 103, 104 in opposed relation. A flat packing ring 108 is slidably disposed on the outer face of the end walls of the rotors 85 and 86 and is apertured to receive the foot lugs 107.

A first pair of rollers 109 are rotatably mounted on the foot lugs 107, and a second pair of rollers are rotatably mounted on the packing ring 108, such that the packing ring will move with the rollers relative to the rotors.

As shown in FIG. 6, the circular members 85A, 85B and 86A, 86B are secured together in opposed relation over the blades 101, 102 and 103, 104 to form a circular drum configuration. The outer ends of the blades 101, 102 and 103, 104 extend slidably through the slots 97 and 98 in the circular side walls 87 and 88 and are supported on opposed sides by the rollers 95, 96 as seen in FIGS. 4 and 5. In the assembled condition, the packing ring 108, foot lugs 107, and rollers 109 extend through the slots 93 and 94 in the flat end walls 89 and 90 and the rollers 109 are received and travel in the continuous guide grooves 77 and 78 in the opposed interior surfaces of the flat end walls 75 and 76 of the expander operating chamber 14 and compressor operating chamber 13, respectively, as seen in FIG. 3. A lubricant is supplied to the rollers 109 through channels 110 and lubricators 111. An elastomeric seal collar 112 is installed on the raised interior and exterior peripheral surfaces of the guide grooves 77 and 78 and forms a fluid sealing relation against the exterior surface of the packing rings 108. An elastomeric seal 113 is installed in annular grooves formed in opposed inward facing surfaced of the flat end walls 75 and 76 of the expander operating chamber 14 and the compressor operating chamber 13, respectively. These seals form a peripheral fluid sealing relation between the stationary walls 75 and 76 and rotating flat end walls 89 and 90 of the cylindrical rotor members 85 and 86, respectively.

As best seen in FIGS. 3, 4, and 5 generally L-shaped elastomeric seals 114 are installed in slots 97 and 98 adjacent the rollers 95 and 96 and in grooves at the outer ends of slots 91 and 92 of the cylindrical members 85A–85B and 86A–86B of the gas expander rotor 85 and gas/liquid compressor rotor 86, respectively. These seals enclose the sliding blades on three sides and form a fluid sealing relation between stationary surfaces of slots 97, 98 and slots 91, 92 of the cylindrical members 85A–85B and 86A–86B and the moving surface of the blades opposite the rollers 95 and 96 and also the edge surfaces of the blades.

As best seen in FIG. 3, a shaft 115 secured to the exterior of one flat end wall 89 of the gas expander rotor cylindrical member 85A extends outwardly from the center of the rotor through a hole in the flat end wall 75 of the gas expander chamber 14 and a coaxial opposed shaft 56 secured to the exterior of the opposed flat end wall 89 of the opposed cylindrical member 85B extends outwardly from its center through a hole in the opposed flat end wall 75 of the expander chamber 14. Similarly, a shaft 55 secured to the exterior of the flat end wall 16 of the compressor rotor cylindrical member 86A extends outwardly from its center through a hole in the flat end wall 76 of the compressor chamber 13 and a coaxial opposed shaft 61 secured to the exterior of the opposed flat end wall 90 of the opposed cylindrical member 86B extends outwardly from its center through a hole in the opposed flat end wall 76 of the gas/liquid compressor chamber 13. The shafts 115, 56, 55, and 61 are journalled in the engine housing by bearings 116 and packing glands 117. The shafts 56 and 55 of the expander rotor 85 and compressor rotor 86 are joined together by splines or other suitable means such that the rotors rotate together. A pulley 70 may be mounted on the outer end of the shaft 61 for power take off.

The centerline "B" of the shafts 52 and 55 of the rotors 85 and 86 is eccentrically offset from the center "A" of the oval-shaped expander and compressor chambers 14 and 13. The offset distance or eccentricity is "L".

When the expander and compressor rotors 85 and 86 turn, the blades 101, 102 and 103, 104 reciprocate radially resting on the rollers 95, 96 mounted in the walls 87, 88 of the cylindrical members 85A, 85B and 86A, 86B to form four vane blades of variable length in the respective operating chamber and function as pistons during the compressing and expansion of the working medium. The radial travel of the blades 101, 102 and 103, 104 is regulated by the guide grooves 77 and 78 in which the rollers 109 at the ends of the foot lugs 49 and packing ring 108 travel.

It should be understood, that although the expander rotor 85 and compressor rotor 86 have been shown and described with a pair of blade members, the rotors may utilize any number of blades.

Figure 4A:
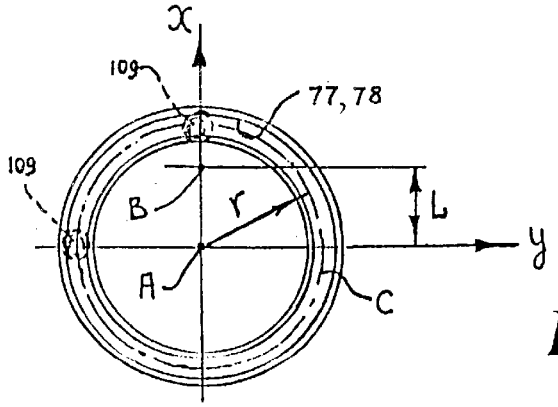
FIG. 4A is a partial elevation view of the guide groove formed in the end walls of the gas/liquid compressor and expander chambers of the power and cryogenic refrigeration system.

Referring now to FIGS. 4, 4A, and 5, the centerline "B" of the shafts 115–61 and rotors 85 and 86 is eccentrically offset from the center of the oval-shaped expander and compressor chamber 14 and 13 and the guide grooves 77 and 78 by a distance L. The sliding-blades 101, 102 and 103, 104 of the expander rotor 85 and compressor rotor 86 are of a predetermined length to provide a constant minimum clearance gap "G" between the outer ends of the blades and the interior surface of the side walls 73 and 74 of the expander and compressor chambers 13 and 14.

In the preferred embodiment, the centerline "C" of the guide grooves 77 and 78 in the rotation plane of the expander and compressor rotors 85 and 86 is the circuit with the radius "r". This radius "r" must be greater than the eccentricity "L". The centerline "C" of the cylindrical guide grooves is defined by the equation: $x^2+y^2=r^2$; where x and y=the vertical and horizontal coordinates, r=the circuit radius, and L=eccentricity of the center of rotor rotation relative to the central axis of the chamber and guide grooves.

The inner surface of the oval of the expander and compressor chamber side walls 73 and 74 in the rotation plane of the rotor are calculated and configured according the equation:

$$\frac{x^2}{h^2}+\frac{y^2}{(h+1/4L)^2-L^2}=1$$

where x and y=horizontal and vertical coordinates, h=half of vane length=half of large oval axis, and L=eccentricity.

Operation

In operation of the bottoming cycle 11 of the system 10, at start up, the throttles 31 and 33 are closed to disconnect the heat exchanger 17 and throttles 39, 36, 43 and 47 are opened to allow flow between the chamber of the gas/liquid compressor 13 and chamber of the gas expander 14 through the heat exchanger bypass conduit 38. The shafts 55, 56, and 61 are rotated by the external drive pulley 70. Rotation of the shaft and rotor of the gas/liquid compressor 13 draws the first gas from the gas expander 14 into the gas/liquid compressor 13. Simultaneously, a fine dispersed low-temperature liquid is injected into the operating chamber of the gas/liquid compressor 13 through the plurality of liquid atomizers to produce a cool gas/liquid mixture. The gas/liquid mixture is compressed in a polytropic process in the compressor 13 and discharged into the vortex separator 15 where the liquid content of the compressed mixture is separated and passed back to the liquid pump to be injected into the operating chamber of the gas/liquid compressor 13.

When the steady duty cycle is reached (determined by the temperature and pressure sensors 20 and 21 in conduit 32) the throttles 39, 47 and 43 are closed to shut off flow through the bypass conduit 38 and conduits 42 and 46, and throttles 31 and 35 are opened to allow flow through the heat exchanger 17 and conduits 30 and 32. During operation, the temperature and pressure sensors 20 and 21 control the operation of throttles 31, 33 and 39 to control the heat exchanger 17. The throttle 47 meters out the non-condensed first gas into the system from the storage tank 18, throttle 43 meters out liquid into the system from the liquid storage tank 19, and throttle 36 controls the distribution of additional first gas and liquid separated by the vortex separator 15 into the respective conduits.

The non-condensable first gas separated from the mixture in the vortex separator 15 enters the heat exchanger 17 where it is isobarically heated using heat of the low-temperature heat source and then enters the operating chamber of the gas expander 14 where it is adiabatic expanded and supercooled and performs useful work by causing simultaneous rotation of the shafts 55, 56 and 61 and rotors of the gas expander 14 and the gas/liquid compressor 13. The adiabatically expanded and supercooled first gas with a cryogenic temperature is discharged from the gas expander 14 and enters the gas/liquid compressor 13 to be mixed with the liquid and serve as a coolant to facilitate rejection of polytropic heat and supplement the cool gas/liquid mixture which is compressed in a polytropic process to complete the bottoming cycle. When the apparatus of the bottoming cycle is used without the apparatus of the topping cycle, it utilizes a low-temperature heat source such as ambient air to produce power and liquefy different gases simultaneously.

Figure 7:
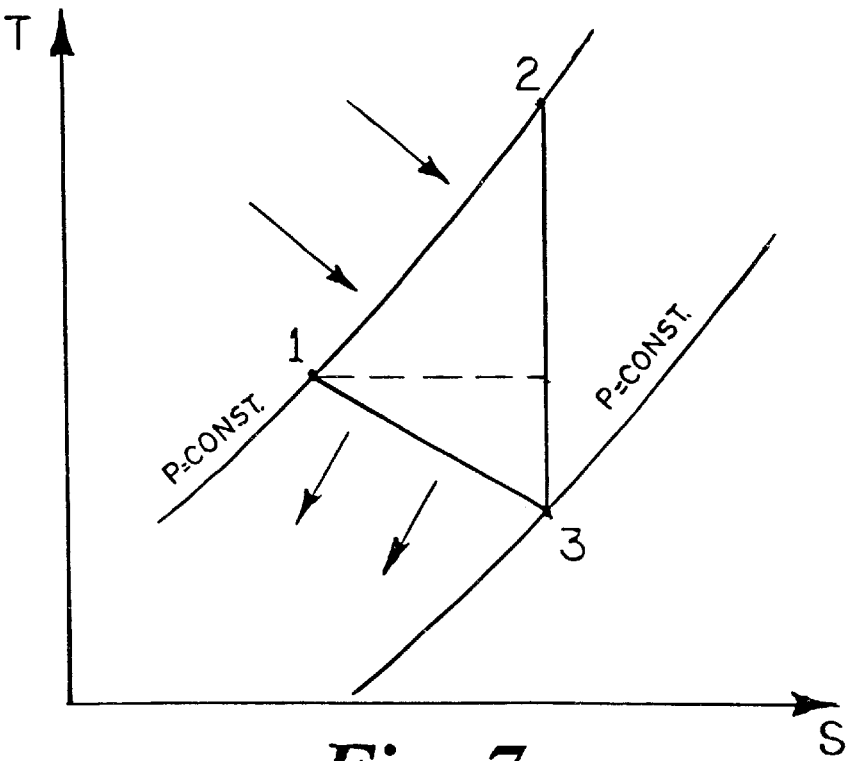
FIG. 7 is a graph illustrating the thermodynamic closed bottoming cycle of the apparatus.

Referring now to the thermodynamic diagram of FIG. 7, as the rotor of the gas/liquid compressor 13 turns, an amount of supercooled first gas at a cryogenic temperature $T_3$ and pressure $P_3$ (point 3 in FIG. 7) is drawn into the operating chamber of the gas/liquid compressor 13, mixed and heat exchanged with fine dispersed liquid to absorb polytropic heat and it is compressed in a polytropic process to a pressure $P_1$ and temperature $T_1$ (point 1 in FIG. 7) and discharged into the vortex separator 15 where the gas and liquid are divided or stratified by centrifugal force.

The separated first gas is discharged into the heat exchanger 17, where it accepts part of the heat of the ambient air or other low-temperature heat source thereby isobarically heating it ($P_1=P_2$) to temperature $T_2$. The compressed and heated first gas enters the operating chamber of the gas expander 14 and is adiabatic expanded from pressure $P_2$ to pressure $P_3$ and supercooled to temperature $T_3$ (point 3 in FIG. 7) by performing useful work in causing rotation of the rotor of the gas expander 14 and through the shafts 55 and 56 simultaneous rotation of the rotor of the gas/liquid compressor 13 and shaft 61. The expanded and supercooled first gas is exhausted from the gas expander 14 into the gas/liquid compressor 13. The separated liquid is heated by absorbing polytropic heat and is also discharged from the vortex separator 15 into the pump 16 and injected into the gas/liquid compressor. The expanded and supercooled first gas is mixed and heat exchanged with the liquid which has adsorbed polytropic heat to renew or supplement the gas/liquid mixture.

The finely dispersed cool gas/liquid mixture is compressed in a polytropic process completing the bottoming cycle (point 1 in FIG. 7).

The polytropic exponent n can by found from the heating balance that occurs by interchanging of the polytropic heat from the liquid to the supercooled first gas.

$$C_{P_{1'}}T_1-C_{P_{1''}}T_3=-C_v\frac{n-k}{n-1}(T_1-T_3)$$

or substitution from part of the equation:

$$T_1=T_3\pi^{\frac{n-1}{n}};\ T_3=T_2\left(\frac{1}{\pi}\right)^{\frac{k-1}{k}}$$

and if $C_{P_1}' \sim C_{P_1}'' \sim C_{P_1}$ will give:

$$n = \frac{2k}{1+k} \tag{1}$$

Where $C_{P1}$=heat capacity of first gas at constant pressure $C_v$=heat capacity at constant volume k=adiabatic exponent

π=

$$\pi = \frac{P_2}{P_3} = \frac{P_1}{P_3} = \text{expansion and compression ratios of the first gas}$$

expansion and compression ratios of the first gas

The dependence of the theoretical specific power $$N_1 \frac{kwt}{kg - {}^\circ k}$$

of the bottoming cycle ( mass flow rate of the working fluid first gas $$\left(\text{mass flow rate of the working fluid first gas } m_1 = 1\frac{\text{kg}}{\text{sec}}\right)$$

is calculated according to the following equation:

$$N_1 = R\left\{\frac{k}{k-1}T_2\left[1-\left(\frac{1}{\pi}\right)^{\frac{k-1}{k}}\right] - \frac{n}{n-1}T_3\left[\pi^{\frac{n-1}{n}} - 1\right]\right\} \tag{2}$$

Equation (2) can be converted to a relative form:

$$\frac{N_1}{T_2} = R\left\{\frac{k}{k-1}\left[1-\left(\frac{1}{\pi}\right)^{\frac{k-1}{k}}\right] - \frac{n}{n-1}\left(\frac{1}{\pi}\right)^{\frac{k-1}{k}}\left[\pi^{\frac{n-1}{n}} - 1\right]\right\} \tag{3}$$

Where

R=specific gas constant

Figure 8:
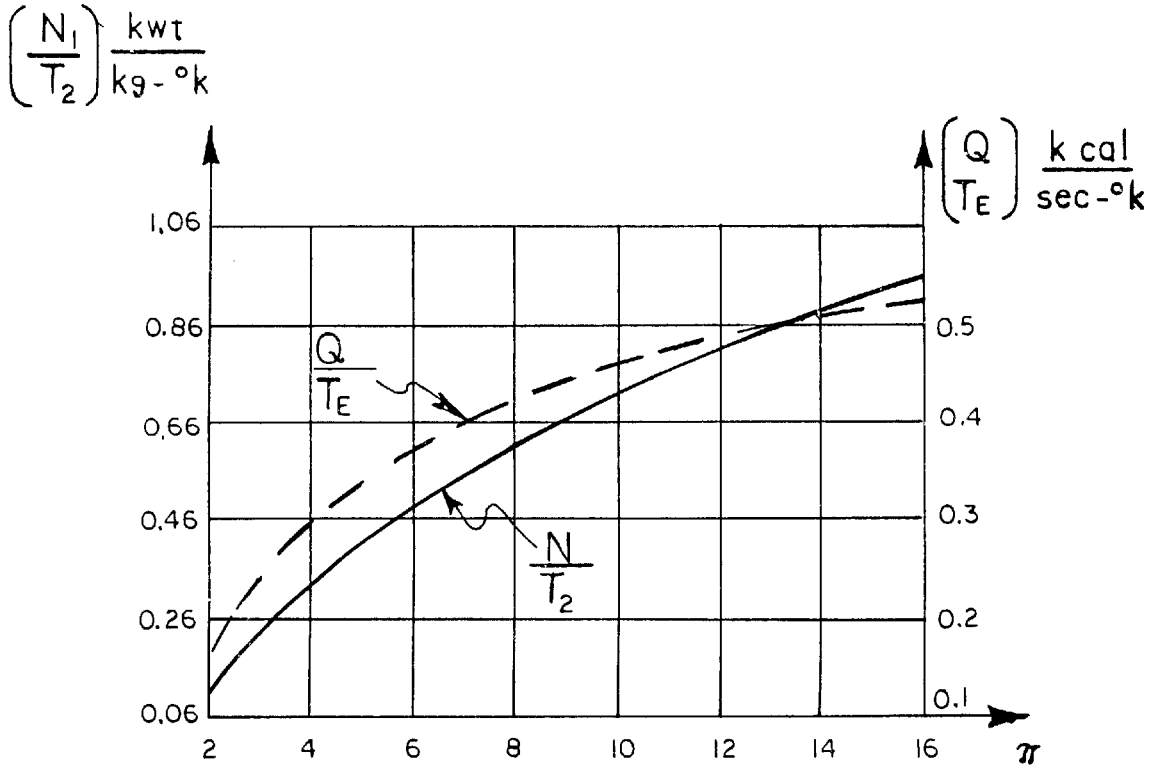
FIG. 8 is a graph showing of the dependence of the theoretical power and the theoretical refrigeration capacity of the bottoming single apparatus using helium as the working medium.

FIG. 8 is a graph showing the dependence of the quantity $$\frac{N_1}{T_2}\frac{kwt}{kg - {}^\circ k}$$

(represented in solid line) on the pressure ratio π of the first gas using helium as a working medium.

If the bottoming cycle uses heat of the ambient air, the theoretical relative refrigerating effect $$\left(\frac{Q}{T_2}\right)\frac{k\text{cal}}{\text{sec} - {}^\circ k}$$

in that case may be calculated according to the following equation:

$$\left(\frac{Q}{T_2}\right) = \frac{C_{P_i}(T_2 - T_1)}{T_2} = C_{P_i}\left[1 - \left(\frac{1}{\pi}\right)^{\frac{k-1}{k}}\pi^{\frac{n-1}{n}}\right]$$

FIG. 8 shows, in dashed lines, the dependence of the quantity $$\left(\frac{Q}{T_2}\right)\frac{k\text{cal}}{\text{sec} - {}^\circ k}$$

on the pressure ratio π of the bottoming cycle apparatus using helium as a working medium.

Mass flow rate $m_2$ of the low-temperature liquid can be found from the heating balance that occurs by interchanging of the polytropic heat to the liquid:

$$C_v\frac{n-k}{n-1}\cdot(T_1 - T_3) = C\cdot m2\cdot(T_1 - T_3)$$

Whence $$m_2 = \frac{C_v}{C}\cdot\frac{n-k}{n-1}, \text{ and}$$

C=heat capacity of the liquid.

In order to utilize the produced power of the bottoming cycle apparatus 11 as a heat pump, the shaft 54 of the rotor of the air compressor 27 is joined to the pulley 70 such that the gas expander shaft 61 and air compressor shaft 54 rotate together. When functioning as a heat pump, cool ambient air is drawn into the air compressor 27 through conduit 67 and it is adiabatically compressed and discharged into the expansion valve 28 where it may be supplied to users as warm air through conduit 69.

The specific output of this heat pump operation $$\left(\text{mass flow rate of the warmed air } m_{air} = 1\frac{\text{kg}}{\text{sec}}\right)$$

may be defined as:

$$\frac{T_W}{T_E} = \frac{\left(\frac{\Sigma N}{T_E}\right)_1}{C_{P_{air}}} + 1$$

Where $T_W$=the warmed supply air temperature $T_E$=the outside air temperature, and $$c_{P_{air}}\frac{\text{k cal}}{\text{sec} - {}^\circ \text{k}} = \text{heat capacity of the air at constant pressure.}$$

Figure 9:
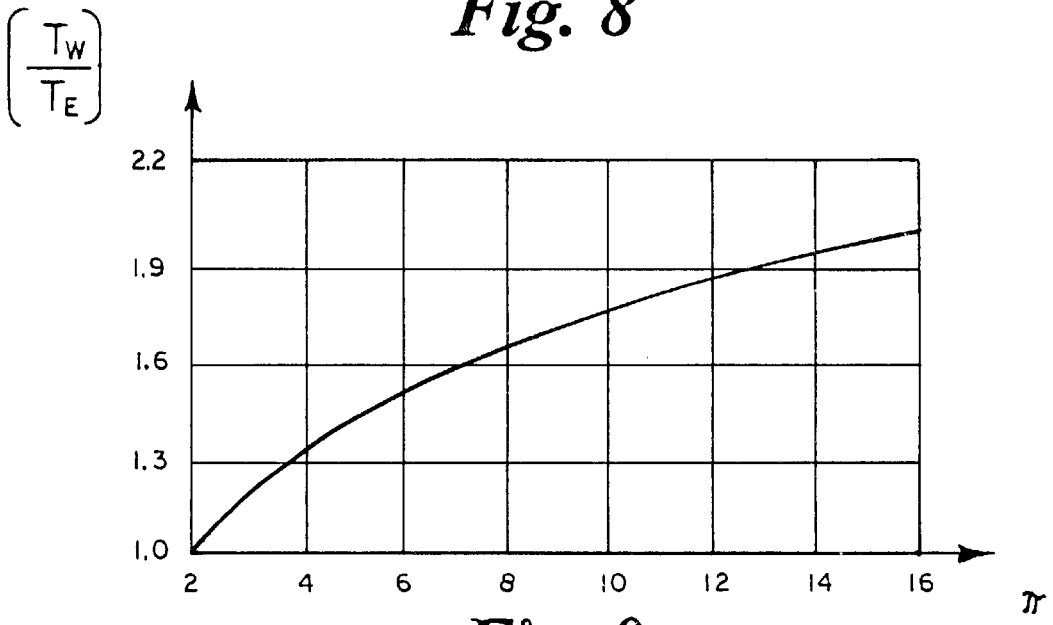
FIG. 9 is a graph showing of the dependence of the theoretical output of the heat pump of the bottoming single apparatus on the pressure ratio using helium as the working medium.

FIG. 9 is a graph showing the dependence of the quantity $$\frac{T_W}{T_E}$$

on the pressure ratio π using helium as a working medium of the bottoming cycle.

Figure 10:
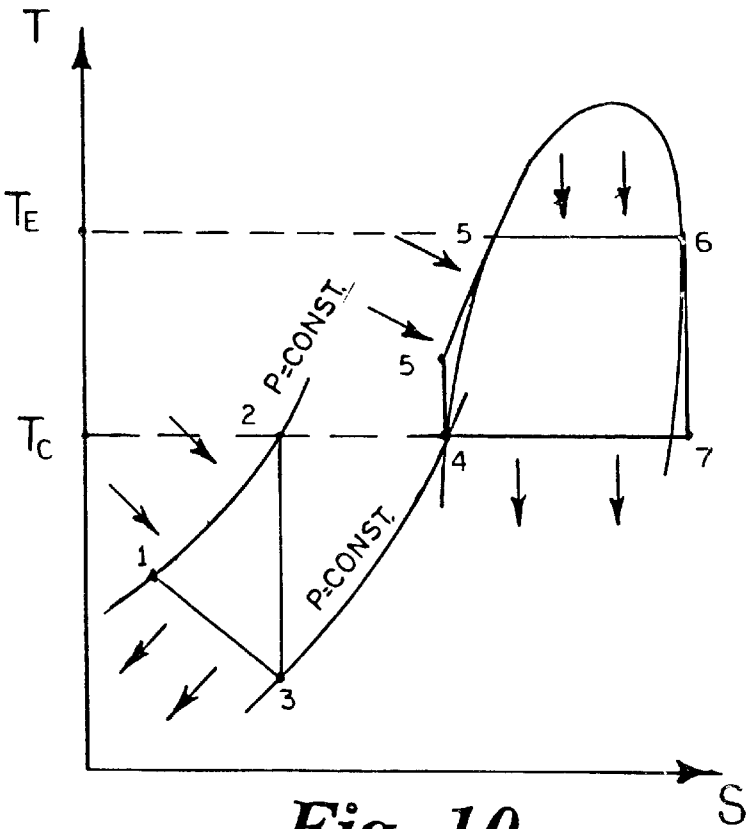
FIG. 10 is a diagram illustrating the thermodynamic cycles of the system having closed bottoming and modified Rankine topping cycles.

Referring now to FIGS. 1 and 10, the working process of the embodiment utilizing the bottoming cycle 11 and the closed modified Rankine toping cycle will be described. As the rotor of the pump 23 turns, the second liquefied gas (ethylene, methane, ammonia, etc.) is drawn through the heat exchanger 17 of the bottoming cycle 11 where it is cooled to temperature $T_4$ and liquefied. The liquefied second gas is compressed to the saturated liquid state to the pressure P' and discharged into the topping cycle heat exchanger-evaporators 25 and 64 where it is isobarically heated to temperature $T_6$ and evaporated using heat of ambient air and seawater or other heat source and then enters the operating chamber of the gas expander 24 where it is adiabatic expanded from pressure $P_6$ to pressure $P_7$ and temperature $T_7$ doing useful work by simultaneously rotating the gas expander 24 and pump 23 rotors.

The expanded second gas is discharged from the gas expander 24 into the heat exchanger 17 of the bottoming cycle 11 and is cooled and liquefied transferring its rejected heat to the first gas. The liquefied second gas is fed to the pump 23 and compressed to the pressure $P_5$' to complete the modified Rankine topping cycle 12 of the system.

The specific power N2 of the topping modified Rankine cycle 11 may be calculated using Mollier diagrams.

The theoretical specific power $$N2\frac{\text{kwt}}{\text{kg}}$$

of the closed topping Rankine cycle 12 of the system 10

$$\left(\text{mass flow rate of the working second gas } m_3 = 1\frac{\text{kg}}{\text{sec}}\right)$$

may be calculated according to the following equation:

$$N2 = C_{P_2}\cdot T_E\left[1-\left(\frac{P_6}{P_7}\right)^{\frac{k_2-1}{k_2}}\right].$$

Where $C_{P_2}$=heat capacity of second gas at constant pressure.

The total theoretical net specific power ΣN of the system 10

$$\left(\text{mass flow rate of the working second gas } m_3 = 1\frac{\text{kg}}{\text{sec}}\right)$$

is calculated according to the following equation:

$$\Sigma N = M\cdot N1 + N2$$

$$\text{Where } M = \frac{m_1}{m_3} = \frac{Q_R}{C_{PI}(T_2-T_1)}, \text{ and}$$

$Q_R$=rejected energy of the topping cycle.

The following is an example calculation of the theoretical specific power N2 of the closed modified Rankine topping cycle 12 (FIG. 1) using ethylene as a working medium (second gas) operating with temperature $T_E=T_5=T_6=300°$ K. and pressure $P_4$=1 ata. Physical constant of the ethylene: boiling temperature $T_2=T_4=T_7=169°$ K.; latent heat of vaporization $$Q_R = 118\frac{\text{kcal}}{\text{kg}};$$

heat capacity $$C_{p2} = 0.37\frac{\text{kcal}}{\text{kg}-°\text{k}};$$

adiabatic exponent $K_2$=1.24 (at P=1 ata and T=290° K.).

The pressure ratio $$\frac{P_6}{P_7}$$

is determined $$\frac{P_6}{P_7}\left(\frac{T_6}{T_7}\right)^{\frac{k_2}{k_2-1}} = \left(\frac{300}{169}\right)^{5.2} = 20$$

The theoretical specific power N2 is equal to $$N2 = CpTE\left[1-\left(\frac{P_6}{P_7}\right)^{\frac{k_2-1}{k_2}}\right]$$

$$= 4.18\cdot 0.37\cdot 300\left[1-\left(\frac{1}{20}\right)^{0.2}\right]$$

$$= 195 \text{ KWT}$$

By pressure ratio of the first gas π=6, the temperatures $T_3$ and $T_1$ equal to $$T_3 = \left(T_7\left(\frac{1}{\pi}\right)\right)^{\frac{k_1-1}{k_1}} = 169\cdot\left(\frac{1}{6}\right)^{0.4} = 83° \text{ K.}$$

$$T_1 = T_3\cdot\pi^{\frac{n-1}{n}} = 83\cdot 6^{0.2} = 119° \text{ K.}$$

Mass flow rate of the working first gas (helium) is determined $$M = \frac{m_1}{m_3} = \frac{Q_R}{C_{PI}(T_2-T_1)} = \frac{118}{1.25(169-119)} = 1.9$$

The total theoretical specific power of the system in the above example is equal to $$\Sigma N = M\cdot N1 + N2 = 1.9\cdot 78 + 195 = 343 KWT$$

(The quantity of specific power N1 is determined by graph FIG. 8)

It should be understood that the modified Rankine open topping cycle may utilize ambient air as the working medium.

While this invention has been described fully and completely with special emphasis upon preferred embodiments, it should be understood that, within the scope of the appended claims, the invention may be practiced otherwise than specifically described herein.

We claim:

1. A method for transforming thermal energy into mechanical energy while simultaneously producing a refrigerant utilizing thermodynamic bottoming and topping cycles and binary working fluids, comprising:

introducing a first gas/liquid working fluid mixture of a non-condensable first gas and a low temperature liquid into a low-temperature closed bottoming cycle;

introducing a second working fluid gas into a topping cycle and compressing and expanding said second working fluid gas in said topping cycle to produce power;

compressing said first gas/liquid working fluid mixture in a polytropic process in said low-temperature closed bottoming cycle, isobarically heating, and adiabatically expanding said first gas/liquid working fluid mixture to produce a refrigerant and power; and utilizing said refrigerant produced in said low-temperature bottoming cycle to cool and liquefy said second working fluid gas of said topping cycle and to facilitate rejection of waste heat.

2. The method according to claim 1, wherein said steps of compressing said gas/liquid working fluid in a polytropic process, isobarically heating, and adiabatically expanding said gas/liquid mixture in said low-temperature closed bottoming cycle comprise the steps of:

introducing said first gas/liquid working fluid mixture into a rotary gas/liquid compressor having a rotor and compressing in a polytropic process therein;

separating said compressed first gas/liquid working fluid mixture into a non-condensable gas component having a low boiling temperature and a liquid component;

isobarically heating said separated non-condensable gas component in bottoming cycle heat exchanger having a second gas as a heat source thereby cooling and liquefing said second gas to produce a cool refrigerated working fluid to be used for said second working fluid gas of said topping cycle and to facilitate rejection of waste heat of said topping cycle;

discharging said isobarically heated first gas component of said first gas/liquid working fluid from said heat exchanger into a rotary gas expander having a rotor operatively connected with said rotary gas/liquid compressor rotor;

adiabatically expanding said separated gas component in said rotary gas expander to simultaneously rotate said gas expander rotor and said rotary gas/liquid compressor rotor and produce useful work and thereby extract heat from said adiabatically expanded gas component to cool it to a temperature below the boiling point of said liquid component and facilitate rejection of waste heat from said bottoming cycle;

discharging a portion of said adiabatically expanded cooled gas component from said rotary gas expander into said rotary gas/liquid compressor; and atomizing and injecting a portion of said separated liquid component into said rotary gas/liquid compressor and mixing it with said cooled gas component to serve as a coolant for said liquid component, to adsorb polytropic heat and supplement said gas/liquid mixture to facilitate polytropic compression of said first gas/liquid working fluid mixture therein.

3. The method according to claim 2, wherein said steps of compressing and expanding said second working fluid gas in said topping cycle comprise the steps of:

drawing said cooled and liquefied second working fluid gas from said bottoming cycle heat exchanger and introducing it into a topping cycle rotary pump means having a rotor and compressing it therein;

isobarically heating said compressed liquefied second gas in a first topping cycle exchanger having a low-temperature heat source to partially evaporate said liquefied second gas;

discharging said heated liquefied second gas from said first topping cycle heat exchanger into a second topping cycle heat exchanger having a low-temperature heat source passing therethrough and isobarically heating said compressed and partially evaporated second gas and evaporating it fully;

discharging said isobarically heated second working fluid gas from said topping cycle second heat exchanger into a topping cycle rotary gas expander having a rotor operatively connected with said topping cycle rotary pump rotor and said rotary gas expander rotor and said gas/liquid compressor rotor of said bottoming cycle; and expanding said second working fluid gas in said topping cycle rotary gas expander to simultaneously rotate said topping cycle gas expander rotor, said topping cycle pump rotor and said gas expander rotor and said gas/liquid compressor rotor of said bottoming cycle to produce useful work.

4. The method according to claim 3, wherein said low-temperature heat source is selected f rom the group consisting of ambient air, seawater, solar heat, geothermal heat, and mixtures thereof.

5. The method according to claim 1, wherein said non-condensable first gas is selected from the group consisting of helium and hydrogen.

6. The method according to claim 1, wherein said low-temperature liquid is selected f rom the group consisting of nitrogen, methane, water, antifreeze, and mixtures thereof.

7. A method for transforming thermal energy into mechanical energy while simultaneously producing refrigerated air utilizing a mixture of a non-condensable first gas and a low-temperature liquid as a working fluid, comprising the steps of:

introducing a gas/liquid mixture of a non-condensable first gas and a low-temperature liquid into a rotary gas/liquid compressor having a rotor and compressing it in a polytropic process therein;

separating said polytropically compressed gas/liquid mixture into a non-condensable gas component having a low boiling temperature and a low-temperature liquid component;

isobarically heating said separated non-condensable gas component in a heat exchanger using a low-temperature heat source thereby cooling said heat source to produce cool refrigerated fluid therefrom;

discharging said isobarically heated gas component as a working fluid from said heat exchanger into a rotary gas expander having a rotor operatively connected with said rotary gas/liquid compressor rotor;

adiabatically expanding said working fluid in said rotary gas expander to simultaneously rotate said gas expander rotor and said rotary gas/liquid compressor rotor and rotary pump rotor and produce useful work and thereby extract heat from said adiabatically expanded working fluid to cool it to a temperature below the boiling temperature of said low-temperature liquid component;

discharging a portion of said expanded cooled working fluid from said gas expander into said rotary gas/liquid compressor; and atomizing and injecting a portion of said separated low-temperature liquid component into said rotary gas/liquid compressor and mixing it with said expanded cool first gas component serving as a coolant for said liquid component to adsorb polytropic heat and supplement said gas/liquid mixture to facilitate polytropic compression of said gas/liquid mixture therein.

8. The method according to claim 7, wherein said low-temperature heat source is selected from the group consisting of ambient air, seawater, solar heat, geothermal heat, and mixtures thereof.

9. The method according to claim 7, wherein said non-condensable first gas is selected from the group consisting of helium and hydrogen.

10. The method according to claim 7, wherein said low-temperature liquid is selected from the group consisting of nitrogen, methane, water, antifreeze, and mixtures thereof.

11. The method according to claim 7, comprising the further steps of:

drawing a portion of cool outside air into a rotary air compressor having a rotor connected with said rotary gas expander rotor to rotate therewith and adiabatically compressing it therein;

discharging said adiabatically compressed air into expansion valve means for throttling said compressed air to atmospheric pressure to produce warm air.

12. The method according to claim 7, comprising the further steps of:

introducing a gas into said bottoming cycle heat exchanger to cool said gas and to liquefy it by transferring its heat to said first gas; and discharging a portion of said liquefied gas as a finished product.

* * * * *